US006812626B2

(12) United States Patent
Perlo et al.

(10) Patent No.: US 6,812,626 B2
(45) Date of Patent: Nov. 2, 2004

(54) LIGHT SOURCE WITH MATRIX OF MICROFILAMENTS

(75) Inventors: Piero Perlo, Orbassano (IT); Mario Repetto, Orbassano (IT); Bartolomeo Pairetti, Orbassano (IT); Cosimo Carvignese, Orbassano (IT); Denis Bollea, Orbassano (IT); Davide Capello, Orbassano (IT)

(73) Assignee: C.R.F. Societa Consortile per Azioni, Turin (IT)

( * ) Notice: Subject to any disclaimer, the term of this patent is extended or adjusted under 35 U.S.C. 154(b) by 84 days.

(21) Appl. No.: 10/118,247

(22) Filed: Apr. 9, 2002

(65) Prior Publication Data

US 2002/0145385 A1 Oct. 10, 2002

(30) Foreign Application Priority Data

Apr. 10, 2001 (IT) ..... TO2001A0341

(51) Int. Cl.[7] ..... H01K 1/18; H01K 1/02; H01J 1/15

(52) U.S. Cl. ..... 313/316; 313/315; 313/580; 313/578; 313/271; 313/272; 313/273; 313/110; 313/113; 313/112; 313/341; 313/343

(58) Field of Search ..... 313/315, 316, 313/580, 578, 271–273, 110, 112, 113, 341, 343

(56) References Cited

U.S. PATENT DOCUMENTS

| | | | | | |
|---|---|---|---|---|---|
| 5,285,131 | A | * | 2/1994 | Muller et al. | 313/578 |
| 5,300,857 | A | * | 4/1994 | Imai et al. | 313/491 |
| 5,493,177 | A | * | 2/1996 | Muller et al. | 313/578 |
| 5,500,569 | A | * | 3/1996 | Blomberg et al. | 313/578 |
| 5,574,327 | A | * | 11/1996 | Cammack et al. | 313/110 |
| 5,644,676 | A | * | 7/1997 | Blomberg et al. | 392/407 |
| 5,827,438 | A | * | 10/1998 | Blomberg et al. | 219/544 |
| 5,831,382 | A | * | 11/1998 | Bilan et al. | 313/495 |
| 5,844,364 | A | * | 12/1998 | Beardmore | 313/522 |
| 5,956,003 | A | * | 9/1999 | Fisher | 345/73 |
| 6,555,948 | B1 | * | 4/2003 | Noll | 313/112 |

* cited by examiner

*Primary Examiner*—Nimeshkumar D. Patel
*Assistant Examiner*—Karabi Guharay
(74) *Attorney, Agent, or Firm*—Sughrue Mion, PLLC

(57) ABSTRACT

A light source composed of a planar, or substantially level, flat or curved, rigid or flexible, matrix of microfilaments integrated on a single substrate and capable of emitting light by incandescence when supplied by an electric current.

40 Claims, 11 Drawing Sheets

LIGHT SOURCE WITH MATRIX OF MICROFILAMENTS

SUMMARY OF THE INVENTION

The present invention relates to a light source of new conception.

The object of the invention is to produce a planar, or substantially level, light source, flat or curved, which can be used for various types of lighting systems, in particular for lighting devices for motor vehicles, such as headlights and lamps, or for lighting devices inside buildings or outdoors, and lastly as reconfigurable light source for indicator and emergency panels.

With a view to attaining this object, the invention relates to a lighting device comprising a planar, or substantially level, flat or curved, rigid or flexible matrix of microfilaments integrated on a single substrate and suitable to emit light by incandescence when supplied by an electric current, said device comprising:

- a reflecting or transparent substrate,
- a plurality of metal microfilaments capable of emitting light by incandescence,
- a grid of conducting tracks to supply the current to said microfilaments, applied to said substrate,
- a transparent covering layer to permit emission of the luminous radiation, and
- electronic control means to switch on part or all of the microfilaments of the matrix.

According to another characteristic, it is preferable to deposit a thin layer of nanoparticles on the reflecting substrate, with the function of converting, according to a multiphoton absorption process, part of the infrared radiation into visible light.

According to another characteristic, a vacuum is produced in the space inside the device, between the substrate and the covering layer. Alternatively, it is possible to fill this space with a mixture of inert gases to prevent oxidation of the microfilaments, or halogens, in order to increase the luminous efficiency. In this case an injection valve is provided to pump gas inside.

According to another characteristic, interposed between the substrate and the transparent covering layer are one or more intermediate layers, shaped in such as way as to improve control of the beam of light emitted.

It must be mentioned that the use of a matrix of microfilaments has already been proposed for the purpose of producing a display panel (see patent U.S. Pat. No. 5 956 003). Nonetheless, a matrix of microfilaments integrated in a structure of the type described above, for the purpose of producing a light source that can be used in lighting devices has not as yet been proposed.

The upper layer of the device according to the invention is produced with transparent material, such as glass or plastic material. It may be flat, have cavities to house the microfilaments, in order to enhance heat dissipation and limit divergence of the beam, or have a plurality of ridges for the purpose of directing the light beam. This layer must have a thickness capable of maintaining the vacuum or preventing escape of the gases used inside the source. The thickness must generally be greater than 0.5 mm and in the case that plastic material is used.

The substrate of the device according to the invention may be reflecting or transparent.

In the case of reflecting substrate, the radiation emitted by the filament is reflected by the substrate and is emitted from the device through the transparent covering layer. The reflecting substrate may have a flat surface or have cavities to reduce divergence of the beam emitted by the device. The reflecting substrate may be metal (such as in stamped metal plate) or composed of another material (such as glass, quartz, plastic, alumina or silicon) with a metal coating. In the case of metal plate a metal coating is also used to improve reflectance of the layer and reduce the temperature of the device. The metal coating (for example aluminium or silver) may be deposited by evaporation or sputtering. In both cases the reflecting substrate is an electric conductor and must therefore be insulated from the conducting tracks that supply current to the filaments. Insulation of the substrate is obtained with a coating of transparent dielectric material resistant to high temperatures (typically an oxide, such as silicon oxide or titanium oxide). The techniques used for deposition of this layer may be evaporation, dipping, sol-gel techniques or other known techniques.

In the case of transparent substrate (such as glass, quartz or plastic) the light emitted by the filament is emitted from the two opposed faces of the device, with the object of lighting on two sides (this may be useful in the case, for example, of an emergency light or signal). The transparent substrate may be flat, have cavities or a plurality of microridges on the surface with the object of reducing divergence and directing the light beam.

The cavities may be produced by stamping or using any other known technique. The surfaces of the substrate may be provided with housings for the conducting tracks. These housings may be produced simultaneously to the cavities and/or optics.

As already mentioned, at least one intermediate layer is preferably interposed between the substrate and the transparent covering layer. The purpose of the intermediate layer is to further limit divergence of the light beam emitted by the device. It may be produced with the same materials as the substrate and is typically composed of reflecting material. In this case it is also an electric conductor and must therefore be insulated from the supply tracks by an insulating layer. The intermediate layer has a plurality of holes, the internal surface of which has an additional optical function to the function of the cavities of the substrate. In fact, if we wish to house the microfilaments inside paraboloid microreflectors, the internal surface of the holes of the intermediate layer forms the upper section of the paraboloid, while the cavity of the substrate forms the lower part.

It is also possible to insert more than one intermediate layer, such as in the symmetrical configuration with transparent substrate, as shall be illustrated in detail hereunder.

The upper covering part, the intermediate layer and the substrate are provided with means suitable to maintain the vacuum or the internal gas atmosphere. This may be obtained using seals, by fusion or adhesion.

The metal filaments may be in tungsten or other tungsten-based metal alloys (such as rhenium-tungsten). The filaments may have a linear shape or be wound in a spiral to improve the overall luminous efficiency. Alternatively, it is possible to lay more than one filament, in the form of a winding, in line with the optical cavities, in order to improve the luminous efficiency, as will also be described in detail hereunder.

The tungsten microfilament may be laid continuously along all the metal tracks; nonetheless, it only reaches incandescence in the zones with the highest resistance between the ends of the rheophores, where the filament does not touch the track or is not parallel with the track.

The metal tracks in the substrate may be housed in specific seats made on the surface of the substrate and/or the intermediate layer.

The metal tracks may be produced by screen printing or ink-jet; alternatively it is possible to use metal plate tracks bonded to the substrate with appropriate resins. A further technique consists in starting from a single layer of sheet metal and producing the tracks using the etching technique (technology used for printed circuits). In this case the cavities in the substrate may be produced subsequently by removing the material from the substrate above the tracks.

To improve control of divergence of the beam it the conducting tracks may transgress inside the cavities. In this case the projecting ends may remain suspended in the cavities (if they have sufficient mechanical visibility) or may be supported by specific arms produced in the substrate simultaneously to the cavities.

BRIEF DESCRIPTION OF THE DRAWINGS

Further characteristics and advantages of the present invention shall become apparent from the description below, with reference to the accompanying drawings, provided purely as non-limiting examples, in which.

DETAILED DESCRIPTION OF THE INVENTION

Figure 1:
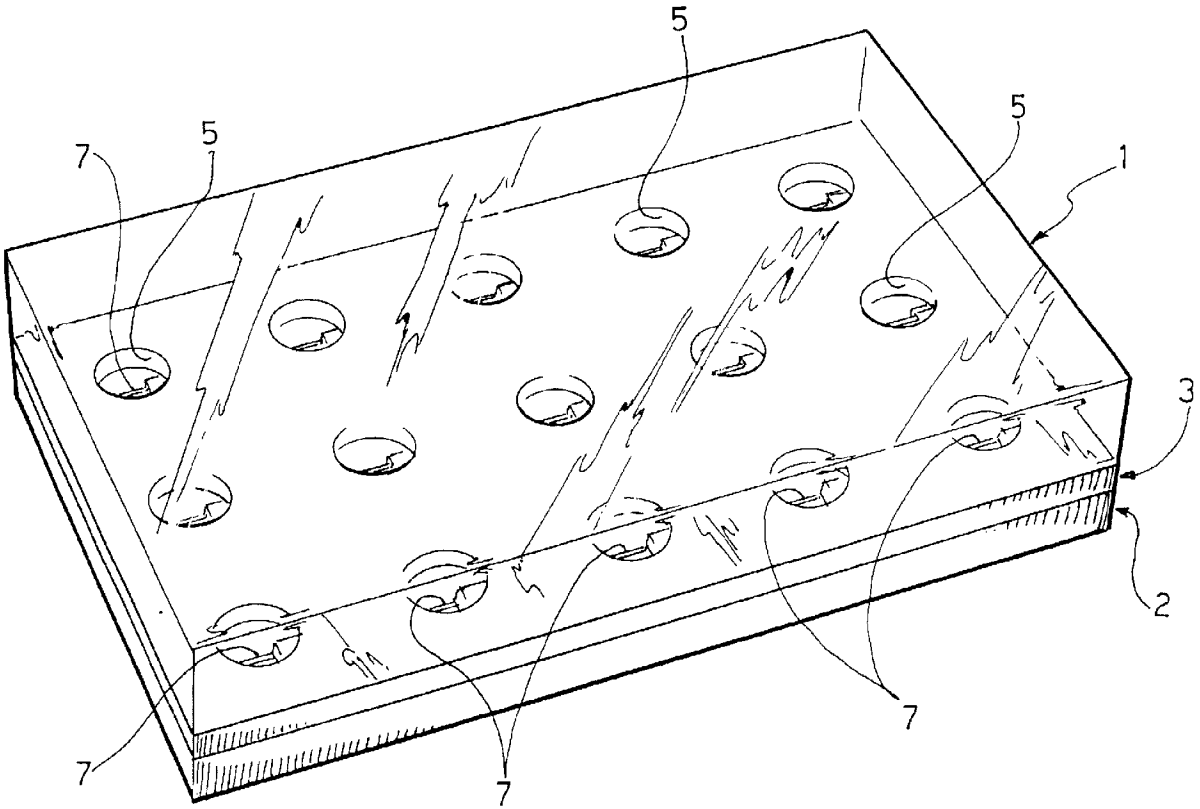
FIG. 1 is a perspective view of a first embodiment of the device according to the invention.
Figure 2:
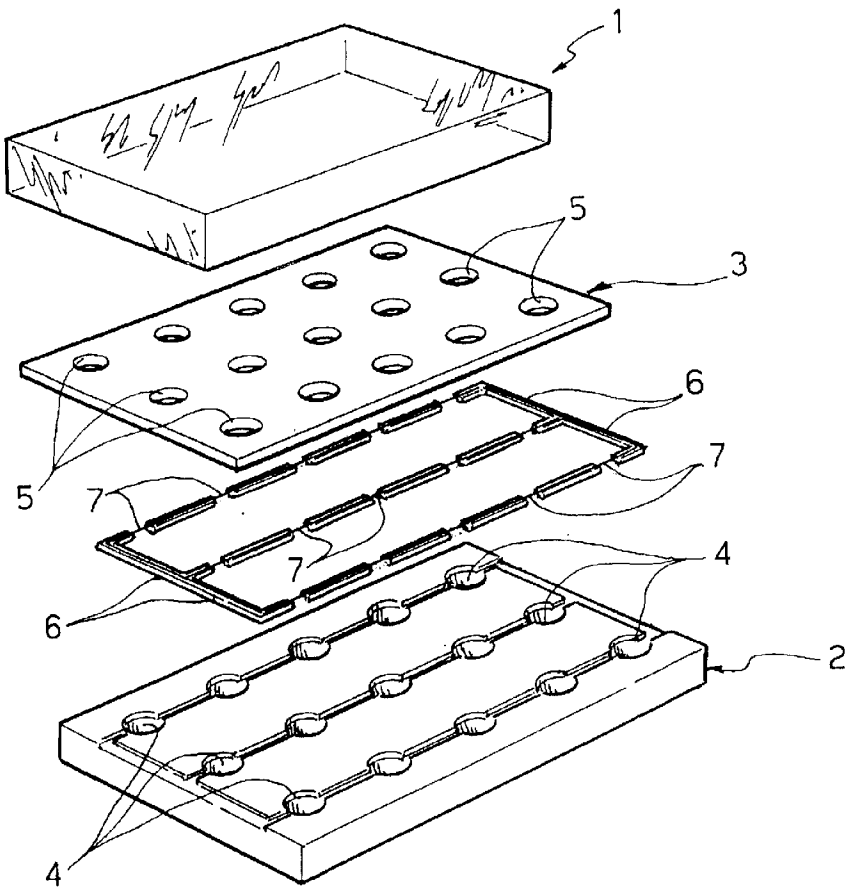
FIG. 2 is an exploded perspective view of the device in FIG. 1.

FIGS. 1–6 of the accompanying drawings show a first embodiment of the device according to the invention, with reflecting substrate. The number 1 indicates as a whole the transparent covering layer, while the reference numbers 2, 3 indicate the substrate and the intermediate layer respectively. The substrate 2 bears a plurality of optics 4 in the form of cavities with reflecting surfaces each associated with one microfilament of the matrix of the device. The microfilaments are indicated with the reference number 7 and are carried by a grid of metal tracks 6 applied over the upper face of the substrate 2. Arranged over the grid of metal tracks 6 is the intermediate layer 3 with holes 5 defining the same number of optical surfaces forming the light beam emitted from the respective microfilament.

Figure 3:
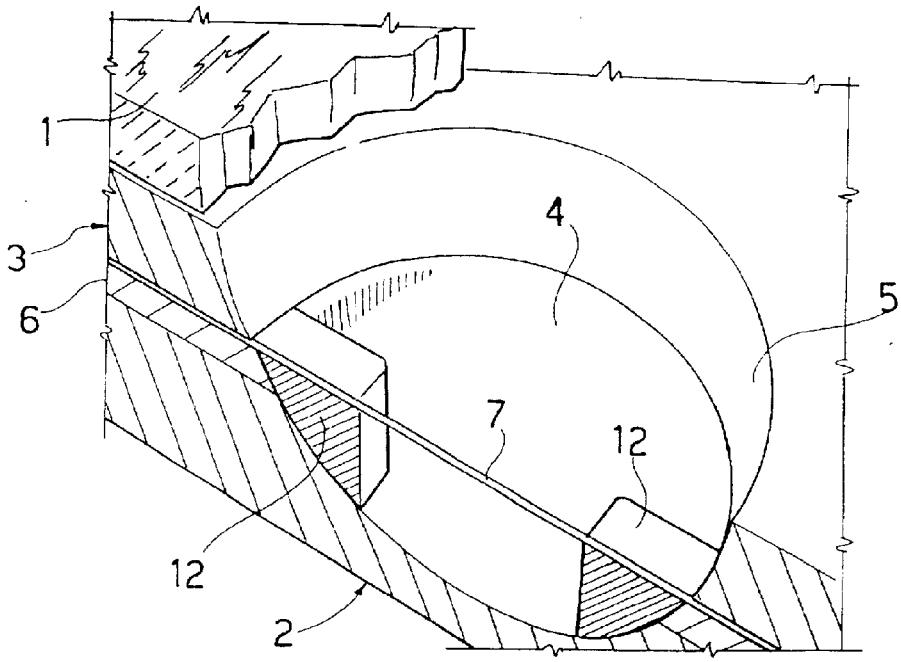
FIG. 3 is a perspective sectional view in an enlarged scale of a detail of the device in FIG. 1.
Figure 4:
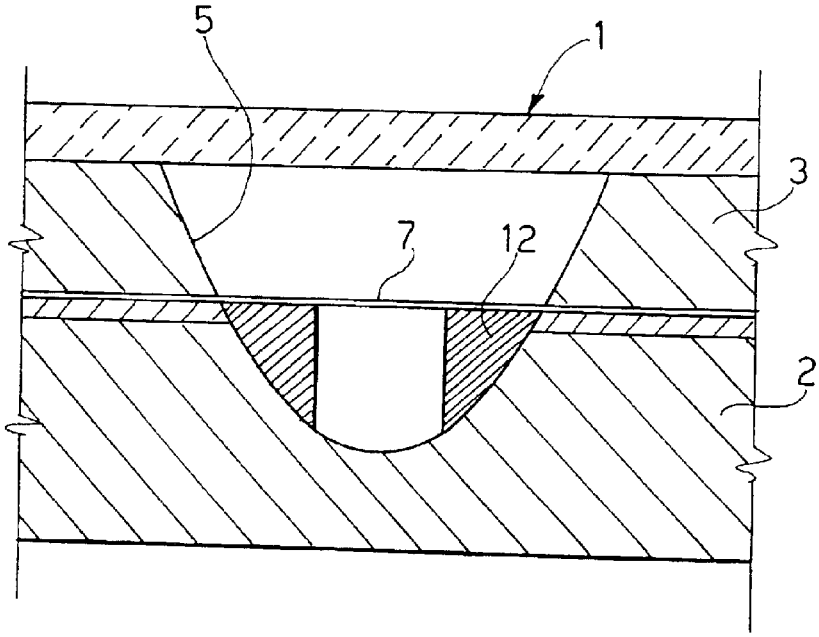
FIG. 4 is a sectional view of the detail in FIG. 3.
Figure 5:
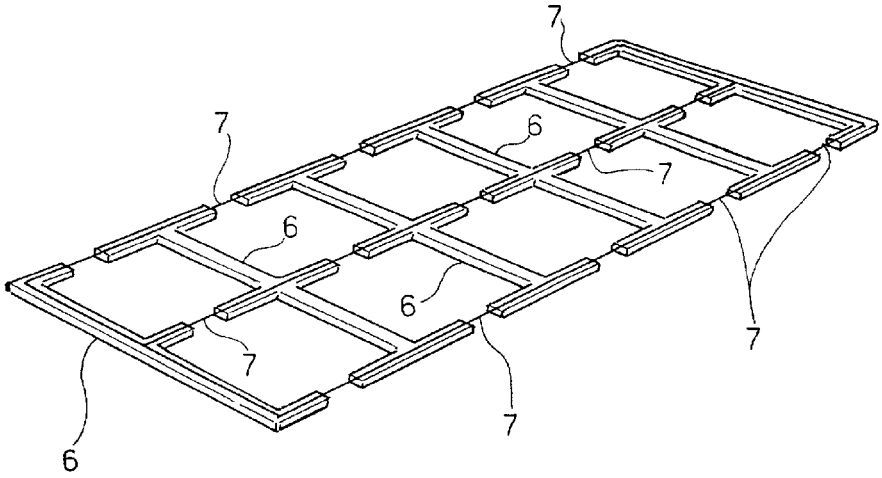
FIG. 5 is a perspective view in an enlarged scale of the metal tracks and microfilaments included in the device according to the invention.
Figure 6:
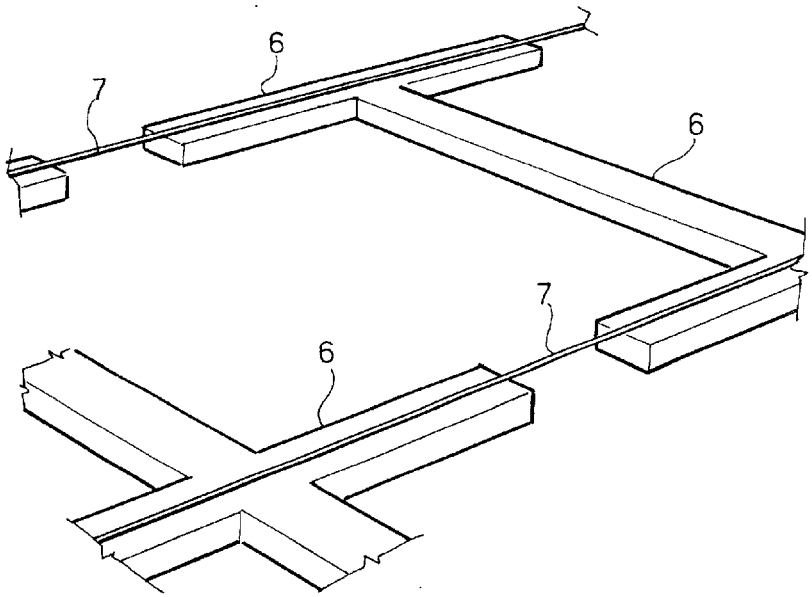
FIG. 6 is a perspective view in an enlarged scale of a detail of FIG. 5.

FIGS. 3, 4 show in detail a single cell associated with a microfilament 7. As can be seen, the microfilament extends over and at a distance from the surface of the reflecting cavity 4, supported at the end by supports 12 and connected electrically to the tracks 6 which are interposed between the intermediate layer 3 and the substrate 2. FIGS. 5, 6 clearly show the structure of the electric tracks 6 and the microfilaments 7 that extend over each reflecting surface 4. The spaces inside each cavity 4 and the holes 5 of the intermediate layer, closed at the top by the covering layer 1, are under vacuum, or filled with gas, as described above.

Figure 7:
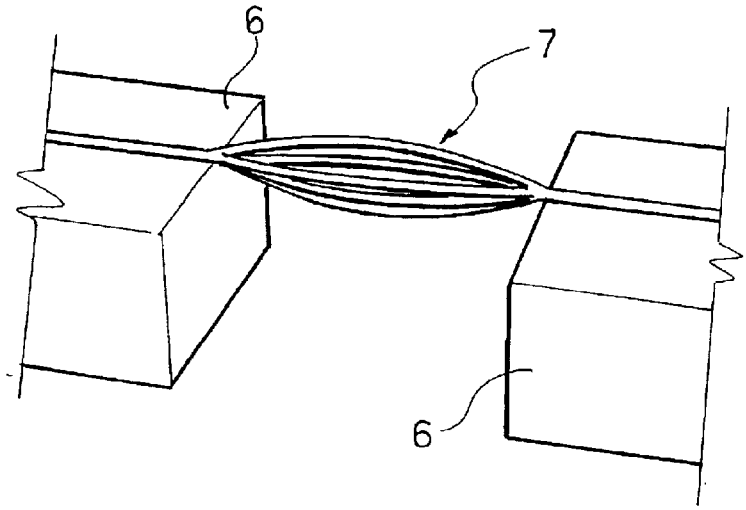
FIG. 7 is a perspective view in an enlarged scale of a variant of microfilament.
Figure 8:
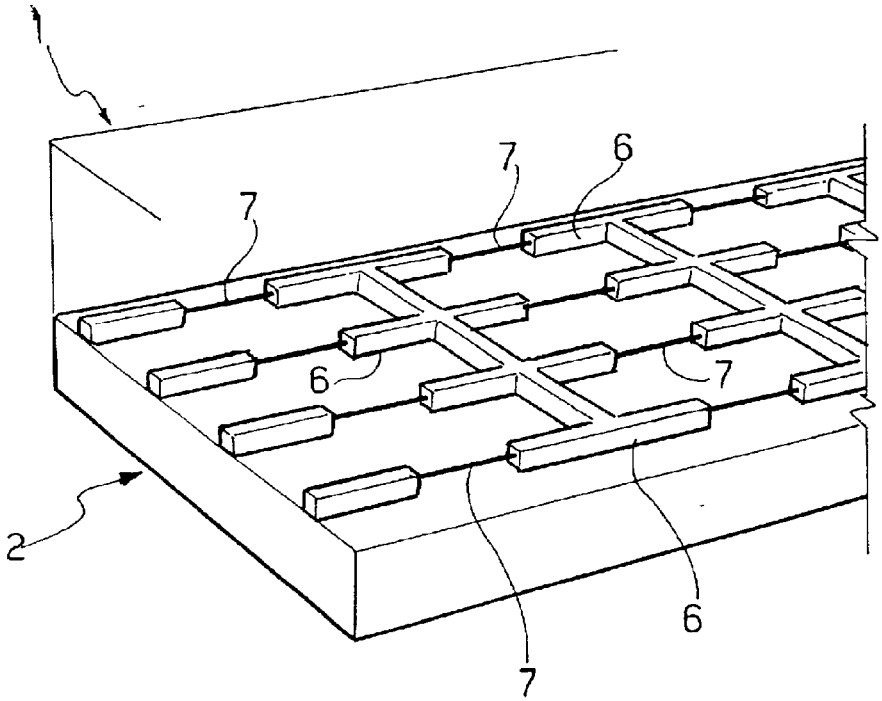
FIG. 8 is a perspective partial view of a second embodiment of the device, utilizing a substrate with flat reflecting optics.

FIG. 7 shows a perspective view of a variant, as described above, in which each microfilament 7 is in the form of a winding composed of several filaments. As also already described above, the microfilament may also have a shape wound in a spiral.

The versatility of the device according to the invention derives, from the optical viewpoint, from the different solutions that may be obtained according to requirements.

The light source according to the invention can be considered an integrated optical device which, in addition to the source function, also has the function of controlling the light beam emitted. Moreover, as this is an extended type of light source, it has two possibilities. The first is of the traditional type, in which each single source has the same optics as the others, optimized to obtain the desired visual output. The second makes it possible to differentiate groups of sources from others with different optics, so that they either perform different functions (such as vehicle headlights) or create, together with the other sources, a superimposition of the desired characteristics.

In general, all the parts constituting the device according to the invention are important from the optical viewpoint.

The transparent upper layer 1 may either have flat faces or it may be composed of a matrix of lenses (one per cell) of the refractive or diffuser type. In the latter case the layer 1 is in the form of a matrix of prisms.

The substrate 2 may be composed of a matrix of mirrors (reflecting surfaces in general), one per cell, to recover light in the case of emission from only the upper part. In the case in which emission is from both sides, this element may also be composed in the same manner as the upper part.

Both parts 1, 2 may also house a system of coloured filters and systems to improve the efficiency of the device, such as a film of material to convert infrared radiation into visible light, or a coating capable of reflecting infrared radiation.

Figure 21:
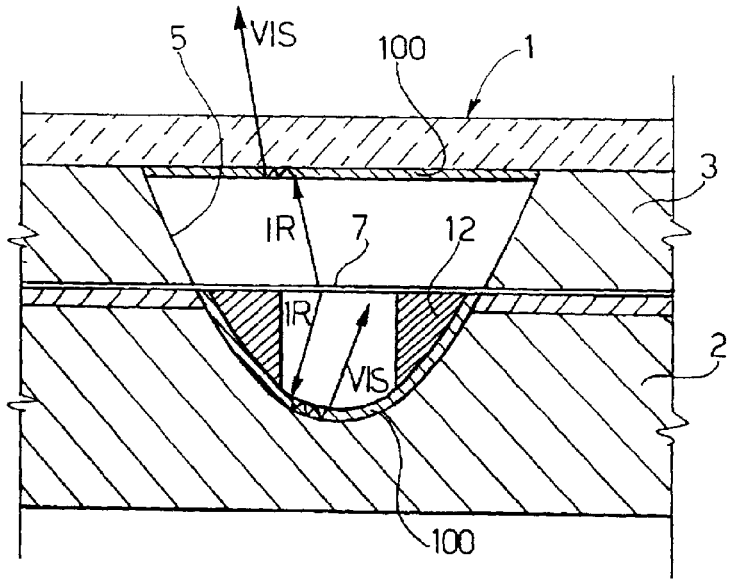
FIG. 21 shows a variant of FIG. 4.

FIG. 1 shows the variant with flat optics, in which the reflector 2 may be composed of a metallized material or have a reflective coating. The transparent part 1 may be smooth to optimize efficiency of the luminous output flow, or of the controlled diffuser type. In both configurations, just as in those to be presented hereunder, it is possible to use coloured filters, of the desired sizes, to differentiate the functions and/or create the desired emission. It is also possible, in the internal part of the covering layer 1, to use a coating capable of reflecting the infrared radiation and transmitting the visible radiation. This coating allows the infrared radiation emitted to be re-used to maintain the temperature of the filament, thus considerably improving the luminous efficiency of the source. Alternatively, the coating may be able to convert photons of the infrared spectral band into photons in the visible spectral band, thus increasing the luminous efficiency of the source. The process may be of non-linear conversion or multiphoton resonant absorption (up-conversion) that induce the generation of harmonics of a higher order or an inelastic scattering process such as stimulated Raman scattering which induces visible radiation through anti-Stokes lines. The coating, which may also be deposited on the reflector as shown in FIG. 21 (reference number 100), may include metal particles of nanometric size, exploiting the presence of these energy transition nanoparticles both in the visible band and in the infrared band. A coating of this type is thus capable of absorbing two or more infrared photons and re-emitting one with more energy of a visible wavelength. In both cases a considerable increase in efficiency can be estimated as most of the radiation of the incandescent sources emits in the infrared spectral band. In the specific case of polychromatic incident radiation, excitation of the energy states desired may occur through absorption of infrared photons with diverse energy. The coating is of a thickness which facilitates multiple reflections of the infrared radiation (IR) centred around 1.2 micron. Conversion of IR radiation into visible radiation is thus maximised.

In the case of continuous film, in an optimum configuration the film acts with non-linear effects which double or triple the frequency of the incident IR radiation. Configuration of the cavity and in particular the position of the filament in the cavity facilitate coupling of the IR radiation in the film which performs energy conversion.

Figure 19:
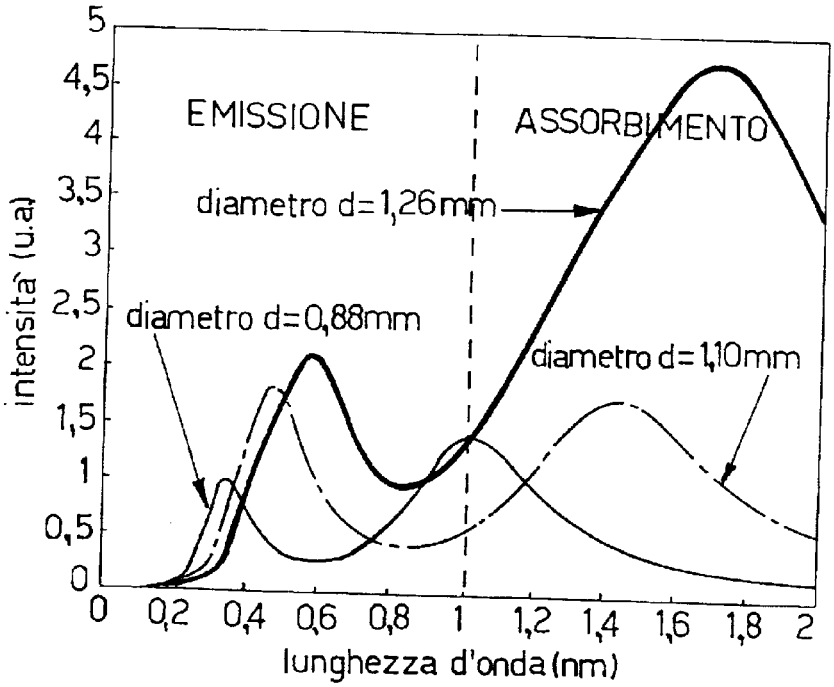
FIGS. 19, 20 show diagrams relative to the absorption spectrum of nanoparticles of silver that may be used in the device according to the invention.
Figure 20:
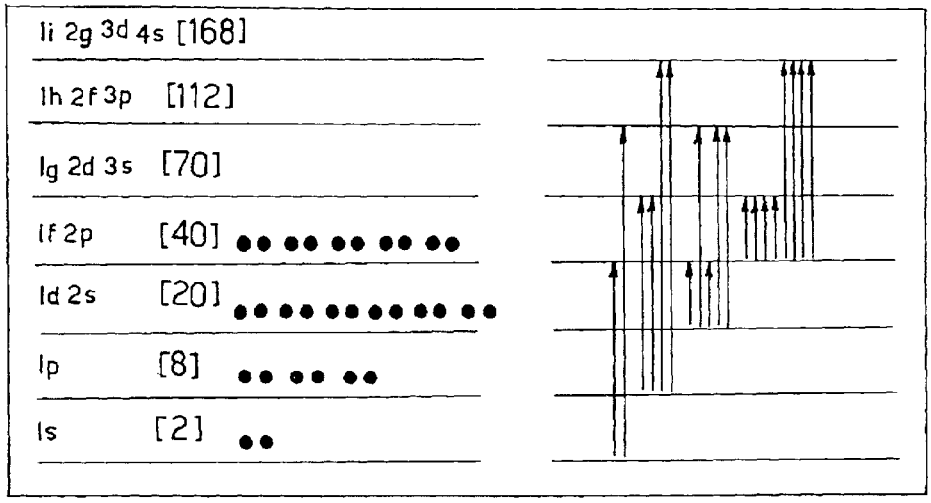

The material used in the film is preferably of the type based on yttrium, ytterbium, lanthanides or rare earths. Nonetheless, in its preferred composition in the form of nanoparticles, experiments have shown that for dimensions of nanoparticles or around one nanometre there is a strong absorption peak in the nearby IR and a high level of re-emission of visible light, as shown in FIG. 19, which relates to silver nanoparticles with diameter between 0.88 and 1.10 nanometres. Analogous behaviour is obtained with other types of nanoparticles such as semiconductors like CdSe, as behaviour is determined prevalently by the dimensions as well as the material. Unlike the case of non-linear optical crystals utilized to generate second or higher order harmonics in laser systems (such as KDP, KTP, CDA..$LiNbO_3$) normally used to convert Nd—YAG laser frequency to green radiation, in the nanoparticles the energy levels are caused by transgression of the electrons in a limited volume. FIG. 20 shows an example of energy levels calculated for a nanoparticle of 1.26 nm in diameter with 30 atoms of silver. The distribution of electrons and electronic transitions permitted between the first 7 levels are indicated. Some correspond to IR photons, others to visible photons. In the case of structured multiatomic particles or more appropriately functional blocks, conversion to visible wavelengths may also and prevalently be induced by molecular rotation and vibration states as well as excited electronic states.

Conversion of infrared radiation into radiation may also be induced by non-linear effects with multiphoton absorption on organic conductive materials. A first example is composed of nanopolyacetylene derivates and PPV derivates conductor polymers. Organic conductive materials preferred for their temperature stability, their excellent photoluminescent efficiency on an extremely broad spectrum, their environmental stability and in particular their extremely low reactivity with water, hydrogen and oxygen, are the family of modified thiophens described in the article published on 31 Jul. –1 Aug. 2000 in SPIE VOL 4134 pages 37–45 by Giovanna Barbarella et al.

Figure 9:
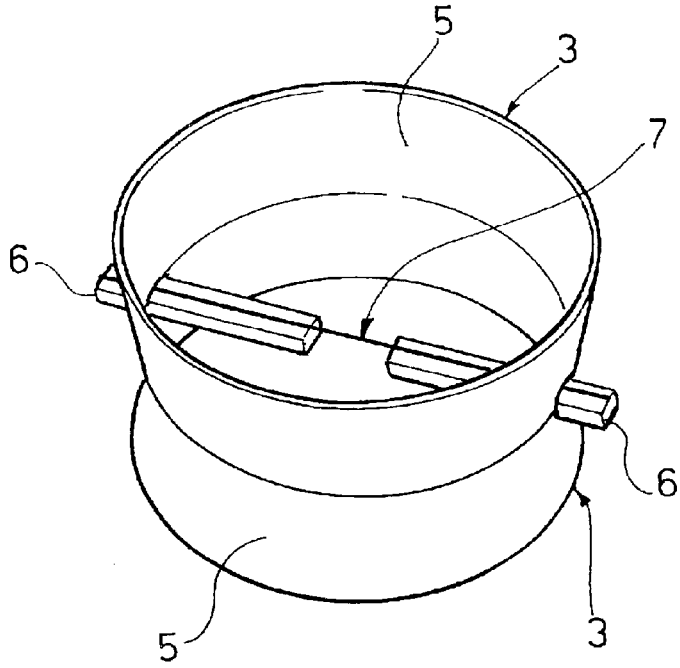
FIG. 9 is a perspective view of a single cell associated with a single microfilament, according to another variant with two reflectors for emission on two sides.

FIG. 9 shows a double emission solution with two reflectors. This type of configuration permits light to be emitted from both parts of the device. The filament 7 is positioned in the centre of the reflectors 5. These are capable of controlling the output angle of the light beam with the maximum efficiency as the photons emitted from the source are emitted from the device with a maximum of one reflection (CPC typology). From the viewpoint of fabrication, the reflectors are produced by creating cavities in the intermediate layers 3. Alternatively, it is possible to insert an optic into the upper part as a controlled diffuser and filters and infrared radiation recuperators as already specified above. The typical dimensions of an optic of this type may be in the order of one millimetre in diameter and half a millimetre in height.

Figure 10:
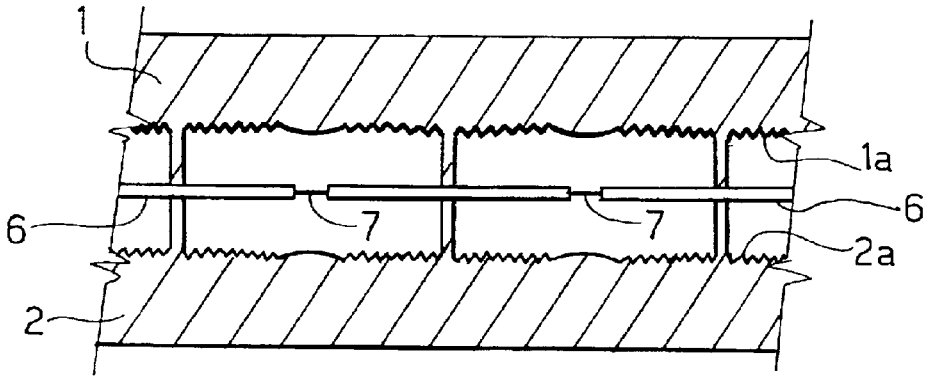
FIG. 10 is a sectional view of a variant with double emission and with two refractive optics.

FIG. 10 shows a solution with double emission with two refractive optics, without intermediate layers. Just as the precedent configuration, this configuration can also emit light from two sides. The peculiarity lies in the fact that there are no reflectors to control the maximum output angle of the light, but a refractive optic (1*a*, 2*a*). The example shows Fresnel lenses.

Figure 11:
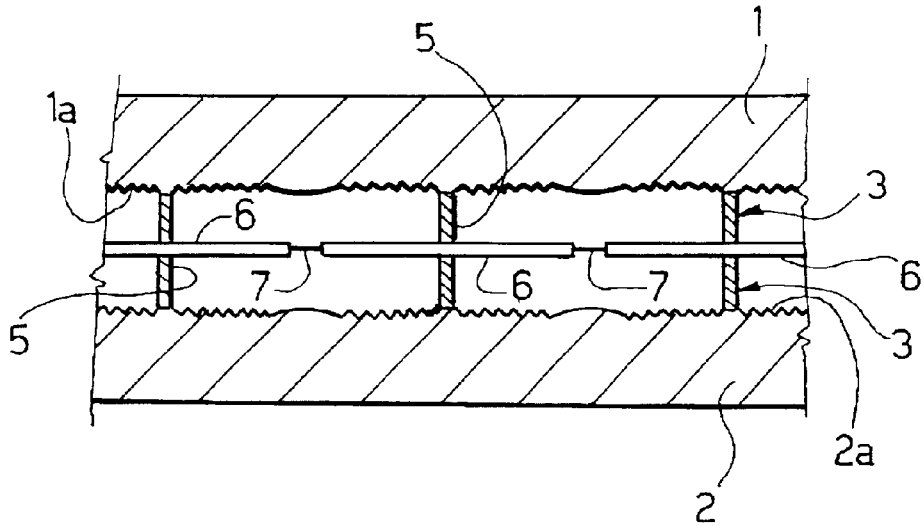
FIG. 11 is another variant with double emission with two refractive optics and with two reflecting intermediate layers.

FIG. 11 is a variant of FIG. 10 in which two intermediate reflecting layers 3 are provided. As already shown, these reflectors are used to confine the light emitted by the microfilaments so that it has a critical angle of emission. A configuration of this type can be compared to the one in FIG. 9, in which intermediate layers with CPC reflectors are provided.

Figure 12:
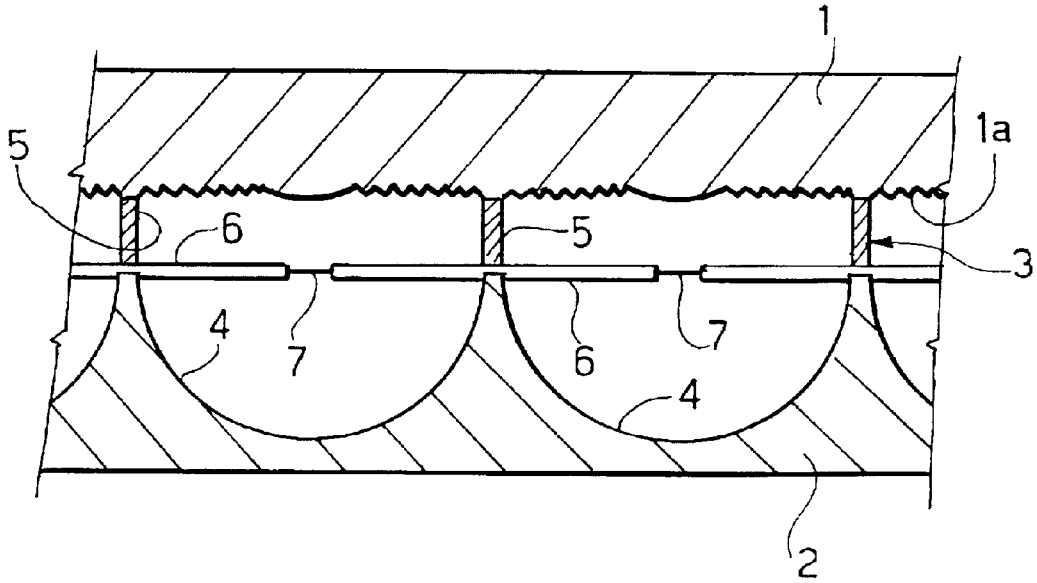
FIG. 12 shows the version with spherical reflector and upper optics.

FIG. 12 relates to the case of a substrate with spherical reflectors 4 and upper optics 1*a* obtained on the lower face of the covering layer 1. This configuration allows light to be emitted from one side. The reflectors reflect light so that some rays return to the source to contribute towards maintaining it at operating temperature. The upper optics may be formed of Fresnel refractive lenses capable of controlling light emission.

Figure 13:
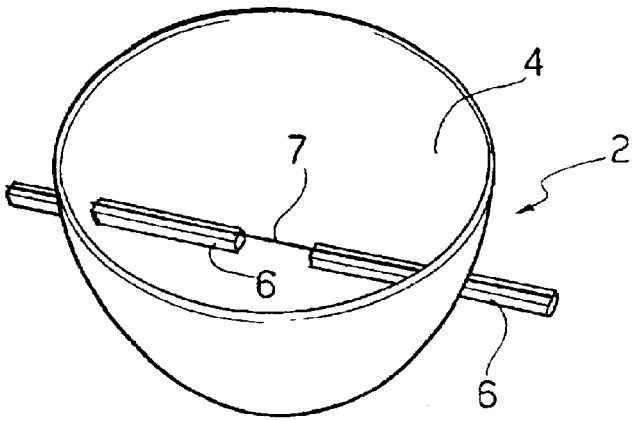
FIG. 13 is a perspective view of a single cell associated with a single microfilament, according to a further variant, using a CPC reflector.

FIG. 13 shows a solution of cell with CPC reflector, capable of reflecting the photons output from the filament 7 with controlled maximum output angle and with maximum efficiency. In this configuration, more than in the others, it is important to minimize the overall dimensions of the tracks or rheophores 6, as this type of reflector guarantees that the majority of the light reflected, which is influenced by the shadow of the rheophores, contributes to the light spot. Also in this case it is possible to use a controlled diffuser in the upper part. The typical dimensions of a reflector of this type are one millimetre in diameter and one millimetre in height.

In the device according to the invention, the light source elements are microfilaments 7. These microfilaments emit light by incandescence when they are crossed by an appropriate electric current and reach a temperature of around 2800° K. The materials used to produce the microfilaments may be tungsten, rhenium-tungsten alloy or other tungsten alloys. Rhenium-tungsten alloy is particularly suitable as it improves the life span of the filament and its mechanical resistance.

To facilitate fabrication, it is possible to lay a filament continuously to guarantee the desired electric configuration. This is possible as the filament is placed in contact with the rheophores which are arranged in such a way as to form the electric configuration. By supplying the ends of the filament, the current is distributed between the rheophores 6, so that if a connection of the filament is broken the current can flow through the rheophores 6 to guarantee operation of the device. The part of the filament not in contact with the rheophores 6 has a higher resistance than the part in contact; therefore, with the same amount of current flowing through the filament, the part not in contact reaches a high temperature by the Joule effect and emits radiation by incandescence. Microfilaments are intended as single pieces of filament which emit light.

Figure 15:
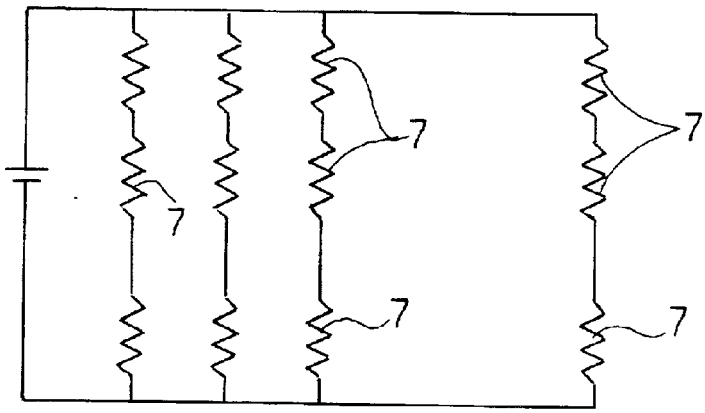
Figure 16:
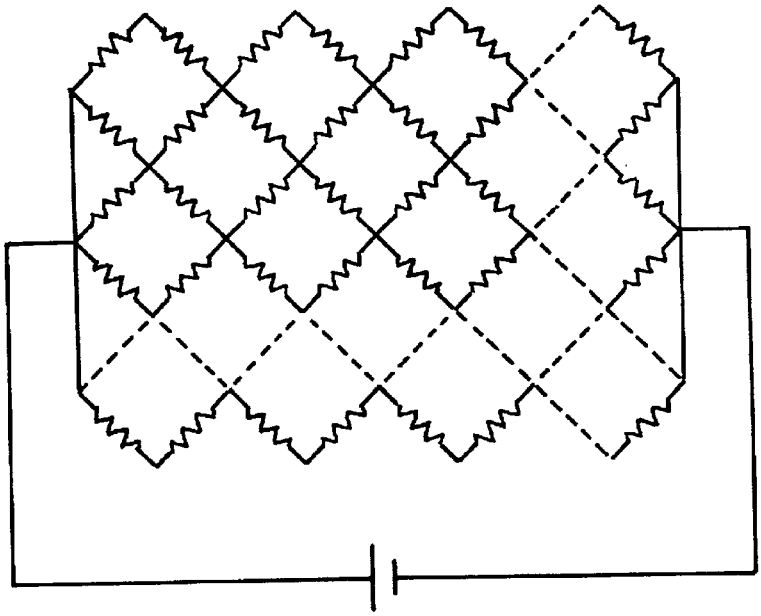

The filament which is laid may be simple, with a circular section, or wound in turns. The latter, in the absence of other techniques to recuperate part of the infrared radiation emitted (as illustrated above) may improve the efficiency of the device, as part of the infrared radiation falls on the turns of the filament to contribute towards maintaining it at operating temperature. The length and section of the microfilaments are calculated by reaching an energy balance between the emitted and absorbed power so that the equilibrium temperature, for a specific current, reaches an optimum temperature for emission. The electric configuration on the one hand is produced in order to take into account both the current and the input voltage of the entire device and the drop in power that must occur at the ends of each microfilament according to the reasoning above. On the other hand, the input supply to the entire matrix is dimensioned on the basis of the number of microfilaments to be used. There are three types of possible electric configurations: series of parallels (FIG. 14); parallel in series (FIG. 15) or a network (FIG. 16). These three configurations make it possible to couple both the input voltage and current with those desired at the ends of each microfilament. The number of series and parallels is designed in order to supply the device at the voltage and current desired so that the use transformers it is not necessary, to the advantage of overall efficiency. The configurations in FIGS. 14 and 16 also offer the advantages of greater stability and duration of the entire device as they allow the device to operate even if a few filaments break. This is possible as if a microfilament breaks the current can circulate in the remaining microfilaments constituting a block, without any significant modification to the current and voltage values in the successive blocks.

Figure 17:
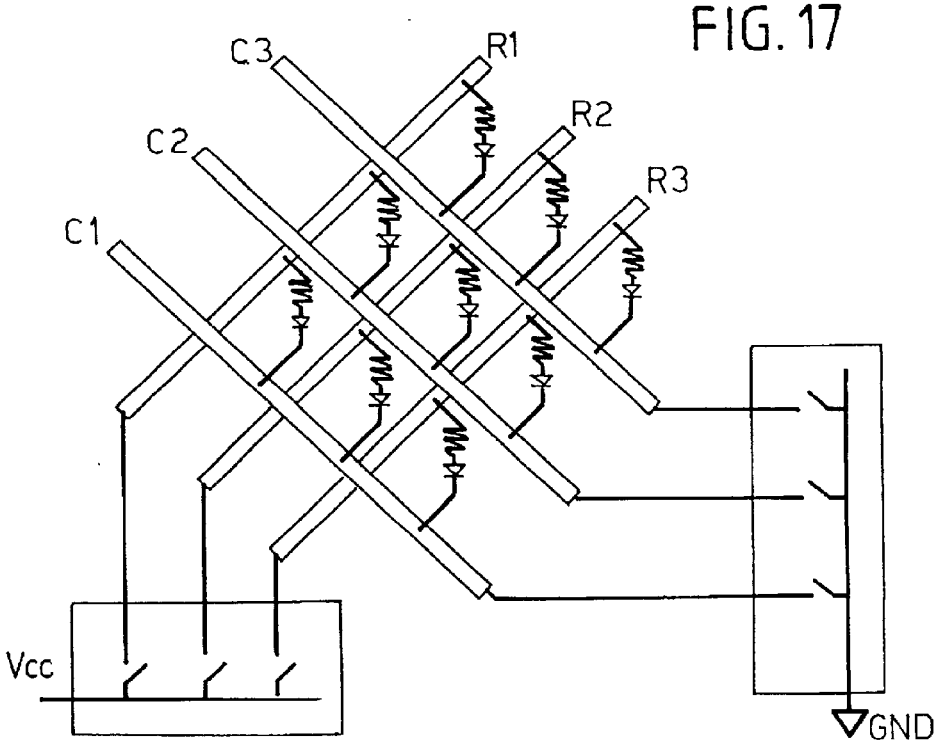
Figure 18:
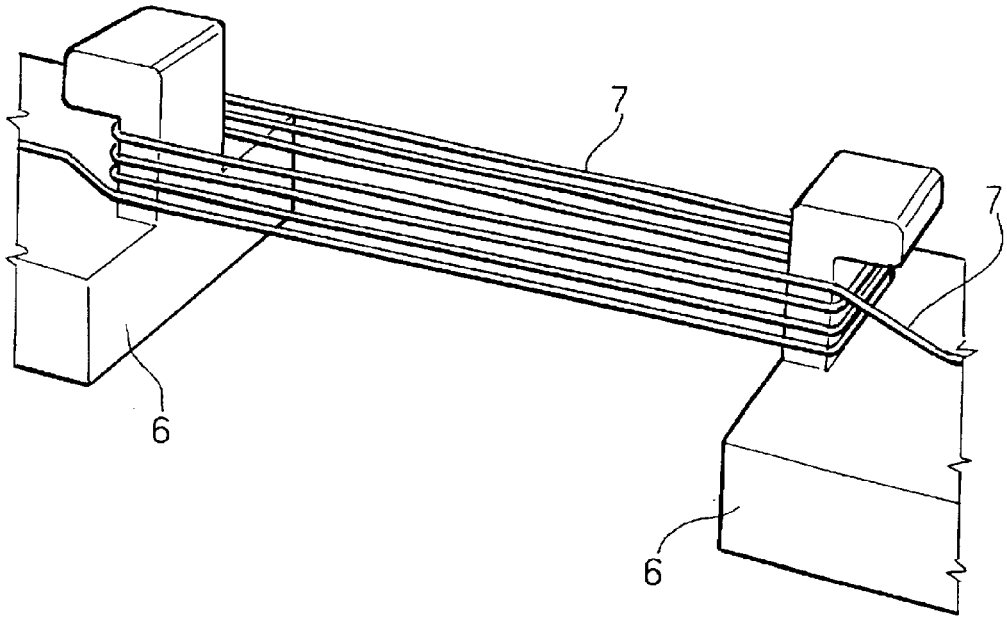
FIG. 18 shows a variant of embodiment of the microfilaments.

If on the one hand the aforesaid configurations offer simplicity in supplying the device, as the entire matrix of microfilaments is considered as a single resistive charge, on the other hand they make it essential to switch on all the microfilaments simultaneously. This type of limit may be overcome by utilizing a more complex configuration in which it is possible to define, inside each single matrix of microfilaments, various independent zones (see FIG. 17) which may or may not be supplied through the use of electronic switches (transistors). The possibility of obtaining a matrix of microfilaments in which the switching configuration can be controlled finds immediate use in the motor vehicle sector, for example, to produce a headlight in which the various functions (brake, reverse, side light, indicators) can be produced by the same device simply by controlling the zones which switch on.

The supply of a matrix of microfilaments, as does the supply of an incandescent lamp, falls within the case of a purely ohmic charge. To choose the power supply of the matrix of microfilaments the following factors must be taken into account:

the duration of microfilaments is greatly influenced by variations in voltage. An overvoltage of 5% reduces the mean duration by about half; vice versa, a reduction in voltage of 5% almost doubles the duration;

the resistance of the filament when cold is 1/10–1/20 of the resistance of the filament when hot. This means that when the lamp is switched on the current has extremely high values, theoretically 10–20 times the operating current (in practice, the value is reduced by the voltage drops in the supply line and in the other interposed elements).

The critical phase, from the mechanical and thermal viewpoint, of the microfilaments is when they are switched on, as tungsten, just as most other metals, has a lower resistant when cold than when hot. To extend the duration of the microfilaments there must be a long temperature transition time. To attain this a thermistor (with negative temperature coefficient NTC) may be used positioned in series with the charge to allow a gradual increase in the current inside the filament with consequent uniform heating of the filament. Different types of thermistor are available on the market for different applications. These have a wide range of resistance and temperature coefficient values, respond rapidly to variations in temperature and are extremely precise and stable.

Besides the use of a thermistor there are various types of contrivances to increase the mean life of a microfilament, although these contrivances decrease efficiency in terms of lumen/watt. One of these contrivances is the use of a diode in series with the filament in the case of an alternating current supply voltage. In this case the supply voltage is applied to the filament only for half a cycle and consequently the filament reaches a lower operating temperature. This increases the mean life of the microfilament although with lower luminous efficiency. In general, the power supply used to switch on the matrix of microfilaments may be of the stabilized type, more or less complex, depending on the degree of control (voltage current) to be attained on the device.

Another type of connection between the various microfilaments 7 forming the device is the "row and column" type, shown in FIG. 16. In this case, it is possible to supply one filament 7 by appropriately selecting the row and column, while retaining the characteristic of overall stability established for the configurations described above. However, prompt control entails the use of management electronics, the complexity of which depends on the dimension of the matrix of microfilaments (rows and columns). Nonetheless, there is still the advantage of having a matrix of points (microfilaments) which can be switched on in a different manner according to requirements. The use of a diode in series with each microfilament is required to eliminate any conductive paths towards other microfilaments which are not selected.

Figure 14:
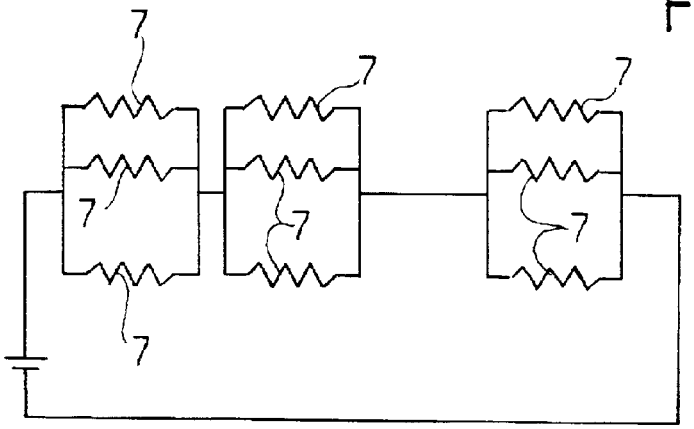
FIGS. 14–17 show alternative layouts of the electric connection of microfilaments included in the device.

With reference again to the layout in FIG. 14, in a concrete example of embodiment, it was seen that a commercial light bulb (for example, of the type P21W) may be replaced by a planar source composed of a matrix of microfilaments with series of parallels electric configuration. Assuming that the supply voltage is 12 volt direct current and we wish to use a filament with a section of 7 microns and a length of around 200 microns, the above light bulb may be replaced with a system of 56 microfilaments arranged in parallel and in turn arranged in series 66 times. The possible dimensions of this new lamp are, for example, 66×56 mm.

FIG. 21 shows a variant of embodiment of the single microfilament.

In general, filaments with a smaller diameter are preferable for the greater surface to volume ratio of the filament.

For example, to maximise efficiency of conversion from electric watts to lumens, repeated paths of a 3 micron filament are preferable to a single 7 micron filament.

Naturally, without prejudice to the principle of the finding, the details of fabrication and embodiments may vary widely from those described and illustrated purely as an example, without however departing from the scope of the present invention.

What is claimed is:

1. Light source, comprising a planar, or substantially level, flat or curved, rigid or flexible matrix of microfilaments integrated on a single substrate and suitable to emit light by incandescence when supplied by an electric current, said device comprising:

a reflecting or transparent substrate, a plurality of metal microfilaments capable of emitting light by incandescence, a grid of conducting tracks to supply the current to said microfilaments, a transparent covering layer to permit emission of the luminous radiation, and electronic control means to switch on part or all of the microfilaments of the matrix, said source comprising a layer for the energy conversion of infrared radiation into visible radiation, wherein at least one intermediate layer is interposed between the substrate and the covering layer, with a purely mechanical function or comprising optics to control the light beam emitted, and wherein said intermediate layer has a plurality of holes the internal surface of which performs an additional optical function to the function of the optical surfaces of the substrate.

2. Light source according to claim 1, wherein a vacuum is produced in the space inside the device, between the substrate and the covering layer.

3. Light source according to claim 1, wherein a mixture of inert gases or halogens is provided in the space inside the device, between the substrate and the covering layer.

4. Light source according to claim 1, wherein the upper layer is produced with transparent material, such as glass or plastic material.

5. Light source according to claim 1, wherein the substrate is reflecting.

6. Light source according to claim 5, in which the reflecting substrate is an electric conductor, and is insulated from the conducting tracks by a layer of dielectric material.

7. Light source according to claim 1, wherein the substrate is transparent.

8. Light source according to claim 1, wherein said substrate has a flat reflecting surface.

9. Light source according to claim 8, wherein the reflecting substrate is metal or composed of nonmetal material such as glass, quartz, plastic, aluminium, silicon, provided with a metal coating.

10. Light source according to claim 1, wherein said substrate has a plurality of curved reflecting surfaces, preferably in the form of cavities, at the different microfilaments, said surfaces being of the type chosen from paraboloid surfaces, spherical surfaces, cylindrical surfaces or similar.

11. Light source according to claim 1, wherein said substrate is flat, or has a plurality of refractive or diffractive microridges on its surface with the object of reducing divergence and directing the light beam.

12. Light source according to claim 1 , wherein the light source comprises several intermediate layers, for example in a symmetrical configuration with the transparent substrate.

13. Light source according to claim 1, wherein each microfilament comprises a bundle of filaments in the form of a winding.

14. Light source according to claim 1, wherein the microfilaments are composed of a material chosen from tungsten or tungsten-based metal alloys.

15. Light source according to claim 1, wherein the metal tracks are produced with a technique chosen from: screen printing, ink-jet, bonding metal plate tracks to the substrate, etching techniques starting from a single layer of metal plate.

16. Light source according to claim 1, wherein the conducting tracks have portions carrying the ends of each microfilament which project inside the respective cavity of the substrate and which are supported by arms produced in the substrate.

17. Light source according to claim 1, wherein the light source includes coloured filters.

18. Light source according to claim 1, wherein the internal surface of the transparent covering layer has a coating capable of reflecting infrared radiation and transmitting visible radiation, so as to re-use the infrared radiation emitted to maintain the temperature of the microfilament.

19. Light source according to claim 1, wherein the transparent covering layer has an internal coating capable of absorbing photons in the infrared spectral band and re-emitting photons in the visible spectral band, thus converting infrared to visible and increasing the luminous efficiency of the source.

20. Light source according to claim 19, wherein the conversion from infrared radiation to visible radiation occurs through the combined effect of generating second harmonics and harmonics of a higher order caused by multiphoton absorption effects and stimulated Raman inelastic scattering.

21. Light source according to claim 19, wherein the conversion from infrared radiation to visible radiation is caused by polymer type organic conductive material inserted in a transparent porous film deposited on the reflector or on the transparent optics.

22. "Light source according to claim 19, wherein the conversion from infrared radiation to visible radiation is caused by a film of organic conductive material of the family of modified thiophens having temperature stability, excellent photoluminescent efficiency on a very wide spectrum, environmental stability and in particular a low reactivity with water, hydrogen and oxygen".

23. Light source according to claim 21, wherein the substrate, which is in transparent material, also has an internal surface with a lens of a type chosen from refractive lens, Fresnel lens, diffractive lens or GRIN lens.

24. Light source according to claim 19, wherein the conversion from infrared radiation to visible radiation is caused by a coating composed of a uniform or porous dielectric layer including metal or semiconductor particles of dimensions in the order of 1 nm.

25. Light source according to claim 1, wherein the light source comprises two intermediate layers which define two reflecting cavities in line with each microfilament to control the output angle of the light beam in two opposed directions.

26. Light source according to claim 1, wherein the transparent covering layer has an internal surface with a lens of a type chosen from refractive lens, Fresnel lens, diffractive lens or GRIN lens.

27. Light source according to claim 1, in which two intermediate layers are provided to define reflecting cavities with CPC characteristics.

28. Light source according to claim 1, wherein the substrate has spherical reflecting cavities suitable to send part of the rays emitted by the respective microfilament back to it, so as to contribute towards maintaining it at operating temperature.

29. Light source according to claim 1, wherein the microfilaments are connected to one another according to a layout in a series of parallels.

30. Light source according to claim 1, wherein the microfilaments are connected to one another according to a layout in a parallel in series.

31. Light source according to claim 1, wherein the microfilaments are connected to one another according to a layout in a network.

32. Light source according to claim 1, wherein the microfilaments of the matrix may be controlled separately, individually or in groups, by means of a connection layout in rows and columns.

33. Lighting device for motor vehicles, wherein it comprises at least one light source according to claim 1.

34. Lighting device for environments inside buildings, wherein it comprises at least one light source according to claim 1.

35. Lighting device for outdoor environments, wherein it comprises at least one light source according to claim 1.

36. Modular lighting device according to claim 1 wherein it is composed of modules at the sides of which connections are provided to allow coupling for the purpose of forming luminous plates or strips supplied from one side only.

37. Light source, comprising a planar, or substantially level, flat or curved, rigid or flexible matrix of microfilaments integrated on a single substrate and suitable to emit light by incandescence when supplied by an electric current, said device comprising:

a reflecting or transparent substrate, a plurality of metal microfilaments capable of emitting light by incandescence, a grid of conducting tracks to supply the current to said microfilaments, a transparent covering layer to permit emission of the luminous radiation, and electronic control means to switch on part or all of the microfilaments of the matrix, said source comprising a layer for the energy conversion of infrared radiation into visible radiation, wherein at least one intermediate layer is interposed between the substrate and the covering layer, with a purely mechanical function or comprising optics to control the light beam emitted, and wherein said intermediate layer is composed of metal material, or non-metal material with metal coating.

38. Light source, comprising a planar, or substantially level, flat or curved, rigid or flexible matrix of microfilaments integrated on a single substrate and suitable to emit light by incandescence when supplied by an electric current, said device comprising:

a reflecting or transparent substrate, a plurality of metal microfilaments capable of emitting light by incandescence, a grid of conducting tracks to supply the current to said microfilaments, a transparent covering layer to permit emission of the luminous radiation, and electronic control means to switch on part or all of the microfilaments of the matrix, said source comprising a layer for the energy conversion of infrared radiation into visible radiation, wherein at least one intermediate layer is interposed between the substrate and the covering layer, with a purely mechanical function or comprising optics to control the light beam emitted, and wherein said intermediate layer is an electric conductor and is insulated from the supply tracks by an insulating layer.

39. Light source, comprising a planar, or substantially level, flat or curved, rigid or flexible matrix of microfilaments integrated on a single substrate and suitable to emit light by incandescence when supplied by an electric current, said device comprising:

a reflecting or transparent substrate, a plurality of metal microfilaments capable of emitting light by incandescence, a grid of conducting tracks to supply the current to said microfilaments, a transparent covering layer to permit emission of the luminous radiation, and electronic control means to switch on part or all of the microfilaments of the matrix, said source comprising a layer for the energy conversion of infrared radiation into visible radiation, and wherein each microfilament is laid continuously along all the metal tracks and have active portions with higher resistance, arranged at a distance from the respective reflecting surface of the substrate, between the respective rheophores.

40. Light source, comprising a planar, or substantially level, flat or curved, rigid or flexible matrix of microfilaments integrated on a single substrate and suitable to emit light by incandescence when supplied by an electric current, said device comprising:

a reflecting or transparent substrate, a plurality of metal microfilaments capable of emitting light by incandescence, a grid of conducting tracks to supply the current to said microfilaments, a transparent covering layer to permit emission of the luminous radiation, and electronic control means to switch on part or all of the microfilaments of the matrix, said source comprising a layer for the energy conversion of infrared radiation into visible radiation, and wherein the substrate has a reflecting cavity of the CPC type for each microfilament.

* * * * *